US008387292B1

(12) United States Patent
Rasmus

(10) Patent No.: US 8,387,292 B1
(45) Date of Patent: Mar. 5, 2013

(54) ROTATABLE PENNANT ASSEMBLY

(76) Inventor: Antonio G. Rasmus, Elmont, NY (US)

( * ) Notice: Subject to any disclaimer, the term of this patent is extended or adjusted under 35 U.S.C. 154(b) by 18 days.

(21) Appl. No.: 13/214,374

(22) Filed: Aug. 22, 2011

(51) Int. Cl.
*G09F 17/00* (2006.01)

(52) U.S. Cl. ..... 40/604; D8/367; 248/304; 15/209.1; 116/173

(58) Field of Classification Search ..... 116/173; 16/87.2; 248/100, 303, 304, 307, 691; 40/586, 40/608, 218, 604; 446/242; D8/367, 383
See application file for complete search history.

(56) References Cited

U.S. PATENT DOCUMENTS

| | | | | | |
|---|---|---|---|---|---|
| D31,995 | S | * | 12/1899 | Alker | D8/370 |
| 1,333,692 | A | * | 3/1920 | Wester | 248/215 |
| 2,869,507 | A | * | 1/1959 | Boyer | 116/173 |
| 3,161,929 | A | * | 12/1964 | Swett | 248/317 |
| 3,395,577 | A | * | 8/1968 | Melville | 73/170.03 |
| 4,004,315 | A | * | 1/1977 | Rials | 15/209.1 |
| 4,979,712 | A | * | 12/1990 | Rios | 248/215 |
| 5,147,703 | A | * | 9/1992 | Provost et al. | 428/82 |
| 5,522,342 | A | * | 6/1996 | Chen-Chao | 116/174 |
| 5,555,603 | A | * | 9/1996 | Chester | 16/87.2 |
| D390,012 | S | * | 2/1998 | Goodman et al. | D6/323 |
| 5,813,080 | A | * | 9/1998 | Hendren | 15/209.1 |
| 5,904,116 | A | * | 5/1999 | Wyner et al. | 116/173 |
| 6,270,048 | B1 | * | 8/2001 | Carlson | 248/339 |
| 6,497,396 | B1 | * | 12/2002 | Adams | 248/304 |
| 6,976,447 | B2 | * | 12/2005 | Spiegel | 116/173 |
| 7,219,388 | B2 | * | 5/2007 | Hale | 15/209.1 |
| D544,220 | S | * | 6/2007 | McConnell | D6/323 |
| 7,350,325 | B1 | * | 4/2008 | Wang | 40/515 |
| D597,825 | S | * | 8/2009 | Ho | D8/367 |
| D608,633 | S | * | 1/2010 | Elmerhaus | D23/293.1 |
| D611,330 | S | * | 3/2010 | Barrese | D8/367 |
| 7,788,835 | B2 | * | 9/2010 | Venn | 40/604 |
| 7,789,358 | B1 | * | 9/2010 | Adams | 248/211 |
| 7,841,117 | B2 | * | 11/2010 | Smith | 40/607.05 |
| D630,089 | S | * | 1/2011 | Kim | D8/367 |
| D630,498 | S | * | 1/2011 | Kim | D8/367 |
| 8,136,209 | B1 | * | 3/2012 | Willison | 16/430 |
| 8,257,135 | B2 | * | 9/2012 | Arcovio | 446/242 |
| 2004/0211019 | A1 | * | 10/2004 | Hale | 15/209.1 |
| 2005/0161570 | A1 | * | 7/2005 | Bauerly | 248/317 |
| 2006/0086307 | A1 | * | 4/2006 | Kaz | 116/28 R |
| 2007/0050904 | A1 | * | 3/2007 | Harwanko | 4/558 |
| 2007/0089338 | A1 | * | 4/2007 | Barnhouse et al. | 40/604 |
| 2010/0017983 | A1 | * | 1/2010 | Song | 15/114 |
| 2011/0173851 | A1 | * | 7/2011 | Cohen | 40/218 |
| 2012/0085004 | A1 | * | 4/2012 | Cohen | 40/218 |

* cited by examiner

*Primary Examiner* — Joanne Silbermann
*Assistant Examiner* — Shin Kim
(74) *Attorney, Agent, or Firm* — Ladas & Parry LLP

(57) ABSTRACT

A rotatable pennant assembly comprising a pennant formed of planar material having a grommet of predetermined diameter "d" proximate an edge, said grommet providing a circular hub having a bearing surface. An elongated, unitary molded member terminating in a bulbous first stop member having a diameter greater than the diameter "d," an axle portion of diameter less than "d" proximate said bulbous portion, and a second stop member spaced from said first stop member adjacent said axle. Said elongated member including a handle portion adapted to be gripped by a user and said second stop member being sufficiently flexible to permit said grommet to pass over it and thereafter to trap said grommet over said axle portion between the first and second stop members, whereby said pennant may be attached to said elongated member through said grommet by a quick-connect snap action for rotation about the axis of said elongated member.

7 Claims, 3 Drawing Sheets

ROTATABLE PENNANT ASSEMBLY

FIELD OF THE INVENTION

The invention relates to a new and improved assembly for a person to wave a small display such as a flag, pennant, banner, or towel in full rotating manner at a sporting event, political rally, or other gathering. The assembly includes a thermoplastic, molded, unitary mast or handle element which rotatably mounts the display element through a grommet.

BACKGROUND OF THE INVENTION

Attendees at sporting events and rallies often show their affection or backing for a team, political figures, or performers by waving displays such as flags, signs, pennants, or towels with indicia such as slogans and colors symbolic of their partisanship. The Pittsburgh "terrible towel" which is waived and rotated by sports fans is exemplary of this type of team support.

Several proposals for mechanically supporting such displays for rotation about an axial support have been developed. These include U.S. Pat. No. 5,904,116 for "Revolving Pennant" showing a revolving pennant attached to a cylindrical collar which in turn is attached to an axle secured to an elongated handle. This device, comprising numerous parts, is complicated to make and to assemble. U.S. Patent Publication No. 20110028065 for "Spinning Towel Assembly" shows a bulbous handle device with a complicated mounting assembly for rotating a towel.

SUMMARY OF THE PRESENT INVENTION

In contrast to the described and known prior art assemblies, the rotatable pennant assembly of the present invention is simple and efficient, having essentially two elements, namely an elongated mast or handle of thermoplastic specially shaped to permit a planar display to be "snapped on" to the handle through a metal grommet affixed to the pennant at an edge portion. To enhance spinning, the display may be folded upon itself through a slit at the distal end to provide weight at the outer edge.

For a better appreciation of the new and improved rotatable pennant assembly, reference should be made to the following detailed description taken in conjunction with the accompanying drawings.

DETAILED DESCRIPTION OF THE INVENTION

Figure 6:
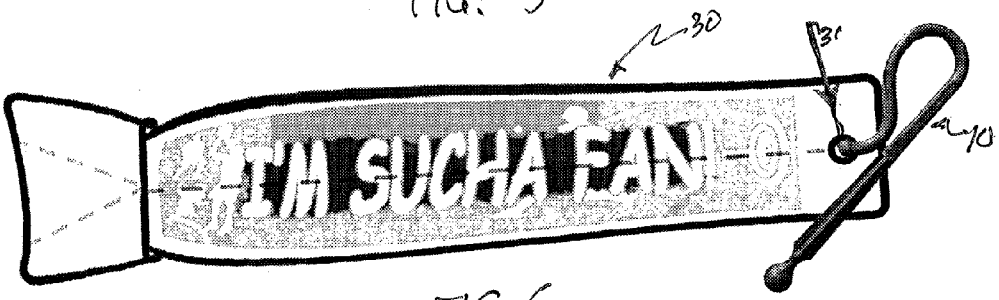
FIG. 6 is a perspective view showing the insertion of the distal end of the mast-handle into the grommet.
Figure 7:
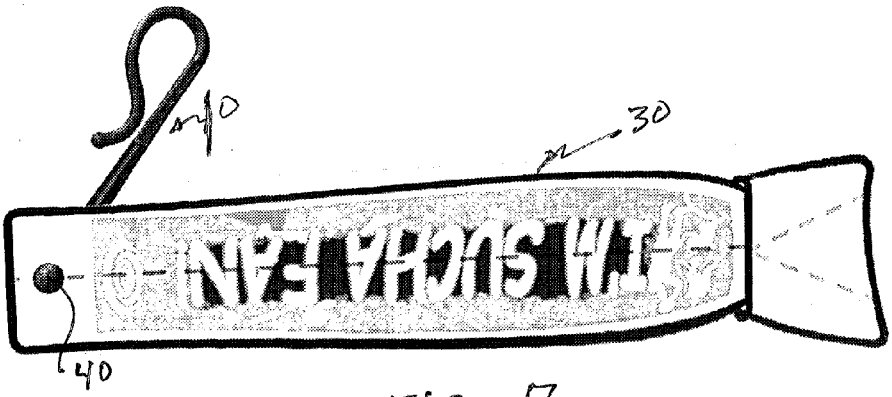
FIG. 7 is a perspective view showing the pennant snapped on to the mast-handle at its top end.
Figure 8:
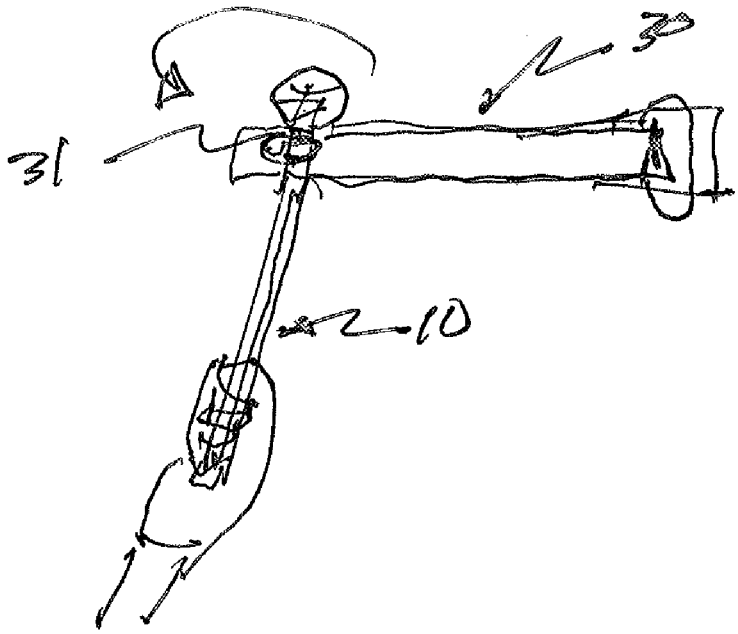
FIG. 8 is a perspective view showing the completed assembly with the pennant rotating about the mast-handle.

Referring now to FIGS. 6, 7 and 8, the rotatable pennant assembly of the invention includes a single unitary thermoplastic mast-handle 10 to which a "pennant" 30 is attached by "snap on" action through a grommet 31, having a predetermined diameter "d," secured at an edge of the pennant 30.

The mast-handle 30, in accordance with the invention, has a lower grippable portion 32 of generally circular cross-section. Advantageously an integral hook portion 33, also of circular cross-section, extends from the grippable portion 32. The diameter of the hook and grippable portions is less than "d" to permit those portions to pass through the grommet when the pennant is attached.

The "mast" portion 34 of the mast-handle 30 includes a tapered splined portion 35 including four splines 36. The lower effective outer diameter formed by their lower outer edge surface is less than "d" and the effective outer diameter of the uppermost outer edge portions 37 is slightly greater than "d." The portions 37 form a lower stop.

A recessed axle portion 38 is formed immediately above the lower stop established by the spline top portions 37, the axle being concave and having diametrical dimensions slightly less than "d."

At the very top of the mast-handle 30 and immediately above the axle is a bulbous upper stop element 40 advantageously spherical in shape and having a diameter greater than "d."

In accordance with the invention, the display element 30 is a generally planar flag, pennant, towel, or sign bearing a special message, logo, and/or colors. The pennant is "snapped on" to the mast-handle by threading the pennant upwardly over the lower portions of the mast-handle 10 (of diameter less than "d") through the grommet 31 as shown in FIG. 6. When the grommet 31 ascends over the splines 36, it encounters no resistance until reaching the spline portions 37 arranged in a diameter greater than "d." However, pursuant to the invention, the mast-handle is molded from a propylene/ethylene copolymer providing sufficient flexibility of the splines 36 to accommodate sufficient flexion or bending to permit the grommet to pass beyond the lower stop established by portions 37 and then be trapped at the axle 38 between the lower stop 37 and upper stop 40.

Figure 1:
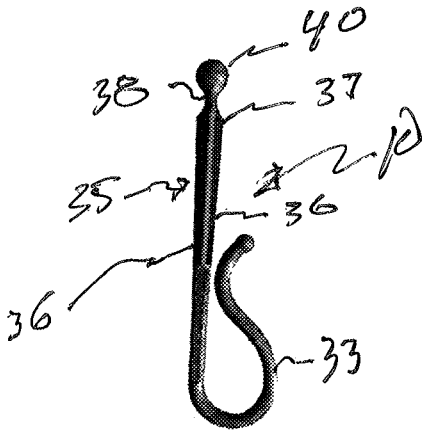
FIG. 1 is a perspective view of the new mast-handle of the present invention.
Figure 2:
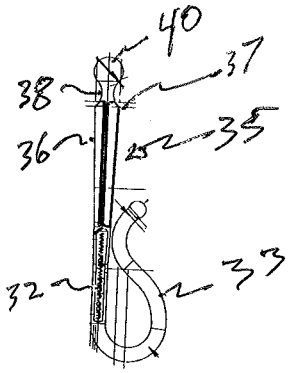
FIG. 2 is a front elevational view of the mast-handle.
Figure 3:
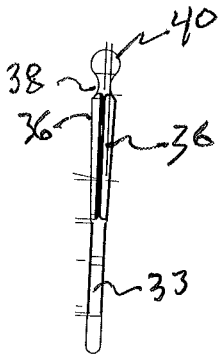
FIG. 3 is a side elevational view of the mast-handle.
Figure 4:
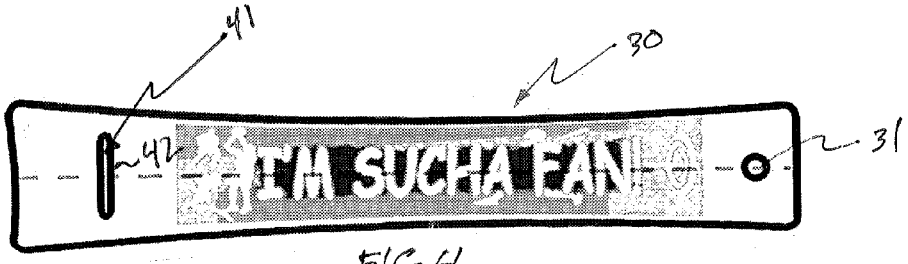
FIG. 4 is a top plan view of a new display element of the present invention with a grommet at one end and a reinforced slit at the other.
Figure 5:
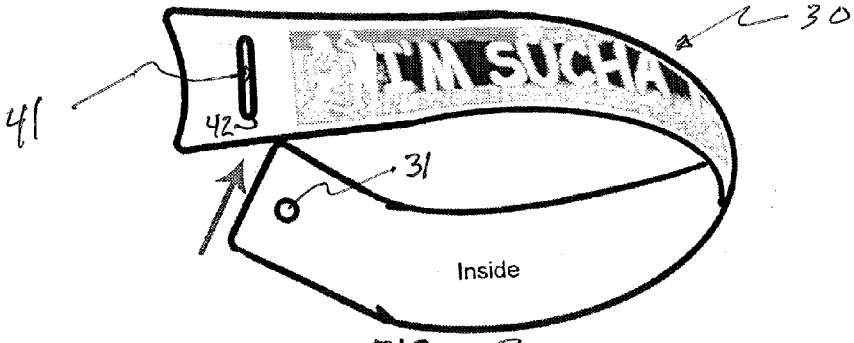
FIG. 5 is a perspective view of the folding of the pennant for passing the grommet end through the slit at the other end.

The display element 30 may be of any particular shape. A preferred embodiment is an elongated rectangle as shown in FIG. 4 with the grommet 31 disposed at the inner end (to be attached to the mast-handle 10) and a slit 41, reinforced by button-hole stitching 42, at the opposite end. The grommet end of the display is inserted (FIG. 5) through the slit 41 and pulled back on itself doubling its thickness and adding extra weight of the pennant at the distal end. This extra weight facilitates the rotational movement of the pennant as shown in FIG. 8. when the mast-handle 10 is moved in a circular motion to cause the pennant to whip around the axle portion 38 through the bearing inner surfaces of the grommet 31.

The pennant 30 may be multi-plied by laminating several layers before forming the slit 41 through all layers. A single rectangular towel may be folded into three layers upon itself, with the grommet 31 serving to join the three plies and the slit 41 and button-hole stitching 42 also traversing the three plies to establish a pennant of the shape shown in FIG. 4.

It will be appreciated that the mast-handle 10 can be of different lengths and of different lower configurations (with or without the hook portion), the important aspect being the provision of an axle between a bulbous top stop element and a spaced stop formed by "snap on" splines. The pennant may be of a variety of shapes, the important aspect being the inclusion of a grommet at an edge which can attach the planar pennant, flag, towel, or sign to the axle by a "snap on" quick connect fastening arrangement.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A rotatable pennant assembly comprising:

(a) a pennant formed of planar material having a grommet of predetermined diameter "d" proximate an edge, said grommet providing a circular hub having a bearing surface;

(b) an elongated, unitary molded member terminating in a bulbous first stop member having a diameter greater than the diameter "d," an axle portion of diameter less than "d" proximate said bulbous portion, and a second stop member spaced from said first stop member adjacent said axle;

(c) said elongated member including a handle portion adapted to be gripped by a user;

(d) said second stop member being sufficiently flexible to permit said grommet to pass over it and thereafter to trap said grommet over said axle portion between the first and second stop members;

(e) whereby said pennant may be attached to said elongated member through said grommet by a quick-connect snap action for rotation about the axis of said elongated member.

2. The assembly of claim 1 in which (a) said second stop member is in the form of tapered splines.

3. The assembly of claim 1 in which (a) said elongated includes an integral hook member at its lower extremity.

4. The assembly of claim 1 in which (a) said elongated member is formed of a copolymer of ethylene and polypropylene.

5. The assembly of claim 1 in which (a) the pennant is a towel.

6. The assembly of claim 5 in which (a) said towel has multiple plies;

(b) said grommet fastens said plies.

7. The assembly of claim 1 in which (a) the distal end of said pennant defines an open slit;

(b) said pennant is folded back upon itself and through the slit to provide a weighted distal end.

* * * * *